US008121503B2

(12) United States Patent
Ozeki

(10) Patent No.: US 8,121,503 B2
(45) Date of Patent: Feb. 21, 2012

(54) IMAGE FORMING APPARATUS, DEVELOPING DEVICE, AND METHOD OF ADJUSTING DEVELOPER

(75) Inventor: Fumitaka Ozeki, Tokyo (JP)

(73) Assignee: Oki Data Corporation, Tokyo (JP)

( * ) Notice: Subject to any disclaimer, the term of this patent is extended or adjusted under 35 U.S.C. 154(b) by 536 days.

(21) Appl. No.: 12/320,034

(22) Filed: Jan. 15, 2009

(65) Prior Publication Data

US 2009/0196639 A1 Aug. 6, 2009

(30) Foreign Application Priority Data

Feb. 5, 2008 (JP) ..... 2008-024750

(51) Int. Cl.
*G03G 15/08* (2006.01)

(52) U.S. Cl. ..... 399/55; 399/283; 399/285

(58) Field of Classification Search ..... 399/55, 399/285, 283, 273, 270, 43
See application file for complete search history.

(56) References Cited

U.S. PATENT DOCUMENTS 5,592,265 A * 1/1997 Sakuraba et al. ..... 399/285
5,781,827 A * 7/1998 Shimada et al. ..... 399/55
7,583,909 B2 * 9/2009 Imamiya ..... 399/55 X
2002/0159796 A1 * 10/2002 Koyama et al. ..... 399/283 X
2004/0136741 A1 * 7/2004 Lee ..... 399/55
2006/0280528 A1 * 12/2006 Do ..... 399/285 X

FOREIGN PATENT DOCUMENTS

JP 04-346372 12/1992
JP 05-333681 12/1993
JP 2004-117961 A * 4/2004
JP 2005-173290 6/2005
JP 2006-317524 A * 11/2006
JP 2006-337684 A * 12/2006

* cited by examiner

*Primary Examiner* — Sophia S Chen
(74) *Attorney, Agent, or Firm* — Kubotera & Associates, LLC

(57) ABSTRACT

An image forming apparatus includes an image supporting member; a developer supporting member for attaching developer to the image supporting member to form a developer image; a regulation member for forming a thin layer of the developer on the developer supporting member; a charge adjustment member for receiving a charge adjustment voltage and contacting with the thin layer of the developer formed on the developer supporting member to adjust a charge amount of the developer; and a charge adjustment voltage switching unit for switching the charge adjustment voltage applied to the charge adjustment member between an image forming voltage upon forming an image and a non-image forming voltage during a preparation operation.

18 Claims, 9 Drawing Sheets

(1) Environment table

| Absolute water amount/H | 0≦H≦1 | 1<H≦5 | 5<H≦10 | 10<H≦15 | 15<H≦20 |
|---|---|---|---|---|---|
| Developer voltage | -220 | -210 | -200 | -190 | -180 |
| Supply voltage | -265 | -270 | -280 | -280 | -280 |
| Regulation blade voltage | -255 | -265 | -280 | -290 | -300 |
| Toner charge adjustment voltage | 80 | * -10 | -100 | -190 | -280 |

(2) Elapsed time table

| Drum count/Ka | 0≦Ka<3000 | 3000≦Ka<5000 | 5000≦Ka<10000 | 10000≦Ka<20000 | Ka≧20000 |
|---|---|---|---|---|---|
| Developer voltage | 0 | 3 | 5 | 10 | 20 |
| Supply voltage | 0 | 0 | -5 | -10 | -10 |
| Regulation blade voltage | 0 | 0 | -5 | -15 | -20 |
| Toner charge adjustment voltage | 0 | * -25 | -45 | -90 | -130 |

(3) Image ratio table

| Image ratio/F | 0≦F<5 | 5≦F<10 | 10≦F<25 | 25≦F<50 | F≧50 |
|---|---|---|---|---|---|
| Developer voltage | 0 | 0 | 0 | 0 | 0 |
| Supply voltage | 10 | 0 | -10 | -15 | -20 |
| Regulation blade voltage | 20 | 0 | -10 | -20 | -30 |
| Toner charge adjustment voltage | 50 | 0 | * 0 | -50 | -100 |

(4) Print frequency table

| Print frequency/Ka-Kb | 0≦Ka-Kb≦50 | 50<Ka-Kb≦100 | 100<Ka-Kb≦250 | 250<Ka-Kb≦500 | 500<Ka-Kb≦1000 |
|---|---|---|---|---|---|
| Developer voltage | 0 | 0 | 0 | 0 | 0 |
| Supply voltage | 0 | 0 | 5 | 10 | 20 |
| Regulation blade voltage | 0 | 0 | 10 | 20 | 35 |
| Toner charge adjustment voltage | 0 | 50 | * 100 | 150 | 200 |

FIG. 3

(1) Environment table

| Absolute water amount/H | 0≦H≦1 | 1<H≦5 | 5<H≦10 | 10<H≦15 | 15<H≦20 |
|---|---|---|---|---|---|
| Developer voltage | -300 | -250 | -200 | -150 | -100 |
| Supply voltage | -300 | -280 | -280 | -265 | -250 |
| Regulation blade voltage | -270 | -265 | -280 | -290 | -300 |
| Toner charge adjustment voltage | 200 | * 50 | -100 | -150 | -300 |

(2) Elapsed time table

| Drum count/Ka | 0≦Ka<3000 | 3000≦Ka<5000 | 5000≦Ka<10000 | 10000≦Ka<20000 | Ka≧20000 |
|---|---|---|---|---|---|
| Developer voltage | 0 | 3 | 5 | 10 | 20 |
| Supply voltage | 0 | 0 | -10 | -20 | -30 |
| Regulation blade voltage | 0 | 0 | -10 | -30 | -50 |
| Toner charge adjustment voltage | 0 | * -35 | -75 | -140 | -180 |

(3) Image ratio table

| Image ratio/F | 0≦F<5 | 5≦F<10 | 10≦F<25 | 25≦F<50 | F≧50 |
|---|---|---|---|---|---|
| Developer voltage | -20 | 0 | 0 | 10 | 20 |
| Supply voltage | 10 | 0 | -15 | -15 | -20 |
| Regulation blade voltage | 20 | 0 | -15 | -20 | -30 |
| Toner charge adjustment voltage | 80 | 0 | * -10 | -60 | -120 |

(4) Print frequency table

| Print frequency/Ka-Kb | 0≦Ka-Kb≦50 | 50<Ka-Kb≦100 | 100<Ka-Kb≦250 | 250<Ka-Kb≦500 | 500<Ka-Kb≦1000 |
|---|---|---|---|---|---|
| Developer voltage | 0 | 0 | -5 | -10 | -20 |
| Supply voltage | 0 | 0 | 10 | 20 | 30 |
| Regulation blade voltage | 0 | 0 | 30 | 40 | 50 |
| Toner charge adjustment voltage | 0 | 60 | * 120 | 190 | 280 |

FIG. 4

| | Environmental condition | | | | | |
|---|---|---|---|---|---|---|
| | Temperature ℃ | 10 | 23 | 22 | 28 | 28 |
| | Humidity %RH | 20 | 25 | 55 | 55 | 80 |
| | Absolute water amount g/m$^3$ | 1.8 | 5.18 | 10.75 | 14.98 | 21.79 |
| Before adopting | Fog | Good | Good | Good | Fair | Poor |
| | Stain | Poor | Fair | Good | Good | Good |
| After adopting | Fog | Good | Good | Good | Good | Good |
| | Stain | Good | Good | Good | Good | Good |

FIG. 7

| | Drum count | 1000 | 3000 | 5000 | 10000 | 20000 |
|---|---|---|---|---|---|---|
| Before adopting | Fog | Good | Fair | Good | Poor | Poor |
| | Stain | Good | Good | Good | Good | Good |
| After adopting | Fog | Good | Good | Good | Good | Fair |
| | Stain | Good | Good | Good | Good | Good |

FIG. 8

| | Drum count | 50 | 100 | 250 | 500 | 1000 |
|---|---|---|---|---|---|---|
| Before adopting | Fog | Fair | Fair | Good | Good | Good |
| | Stain | Good | Good | Good | Fair | Fair |
| After adopting | Fog | Good | Good | Good | Good | Good |
| | Stain | Good | Good | Good | Good | Good |

FIG. 9

IMAGE FORMING APPARATUS, DEVELOPING DEVICE, AND METHOD OF ADJUSTING DEVELOPER

BACKGROUND OF THE INVENTION AND RELATED ART STATEMENT

The present invention relates to an image forming apparatus of an electro-photography type such as a printer, a facsimile, a copier, and the likes.

In a conventional image forming apparatus of an electro-photography type, a charging device uniformly charges a surface of a photosensitive drum, and an exposure device exposes the surface of the photosensitive drum to form a static latent image thereon. After a developing device develops the static latent image to form a toner image on the photosensitive drum, the toner image is fixed to a sheet.

In the developing device, toner is supplied from a toner cartridge. A developing voltage is applied to a developing roller, and a supply voltage is applied to a supply roller. It is configured such that the developing roller abuts against the supply roller, and the developing roller abuts against a regulation blade, thereby creating static therebetween through friction. Accordingly, toner is charged, and a thin layer of toner is formed on the developing roller.

Before an image is formed, the developing device rotates in idle to remove a foreign matter on the photosensitive drum so that a thin layer of toner is stably formed on the developing roller, thereby forming an image with high quality (refer to Patent Reference).

Patent Reference Japanese Patent Publication No. 2005-173290

In the conventional developing device, it is difficult to stably form an image with good quality.

In view of the problems described above, an object of the present invention is to provide an image forming apparatus and a developing device, in which it is possible to solve the problems in the conventional developing device. In the present invention, it is possible to stably form an image with good quality.

Further objects and advantages of the invention will be apparent from the following description of the invention.

SUMMARY OF THE INVENTION

In order to attain the objects described above, according to an aspect of the present invention, an image forming apparatus includes an image supporting member; a developer supporting member for attaching developer to the image supporting member to form a developer image; a regulation member for forming a thin layer of the developer on the developer supporting member; a charge adjustment member for receiving a charge adjustment voltage and contacting with the thin layer of the developer formed on the developer supporting member to adjust a charge amount of the developer; and a charge adjustment voltage switching unit for switching the charge adjustment voltage applied to the charge adjustment member between an image forming voltage upon forming an image and a non-image forming voltage during a preparation operation.

In the present invention, with the configuration described above, it is possible to stably form an image with good quality.

BRIEF DESCRIPTION OF THE DRAWINGS

FIG. 3 is a voltage setting table upon forming an image according to the first embodiment of the present invention;

FIG. 4 is a voltage setting table in a toner charge adjustment sequence according to the first embodiment of the present invention;

FIG. 7 is a table showing a result No. 1 of an experiment according to the first embodiment of the present invention;

FIG. 8 is a table showing a result No. 2 of the experiment according to the first embodiment of the present invention;

FIG. 9 is a table showing a result No. 3 of the experiment according to the first embodiment of the present invention;

DETAILED DESCRIPTION OF PREFERRED EMBODIMENTS

Hereunder, embodiments of the present invention will be explained with reference to the accompanying drawings.

First Embodiment

Figure 1:
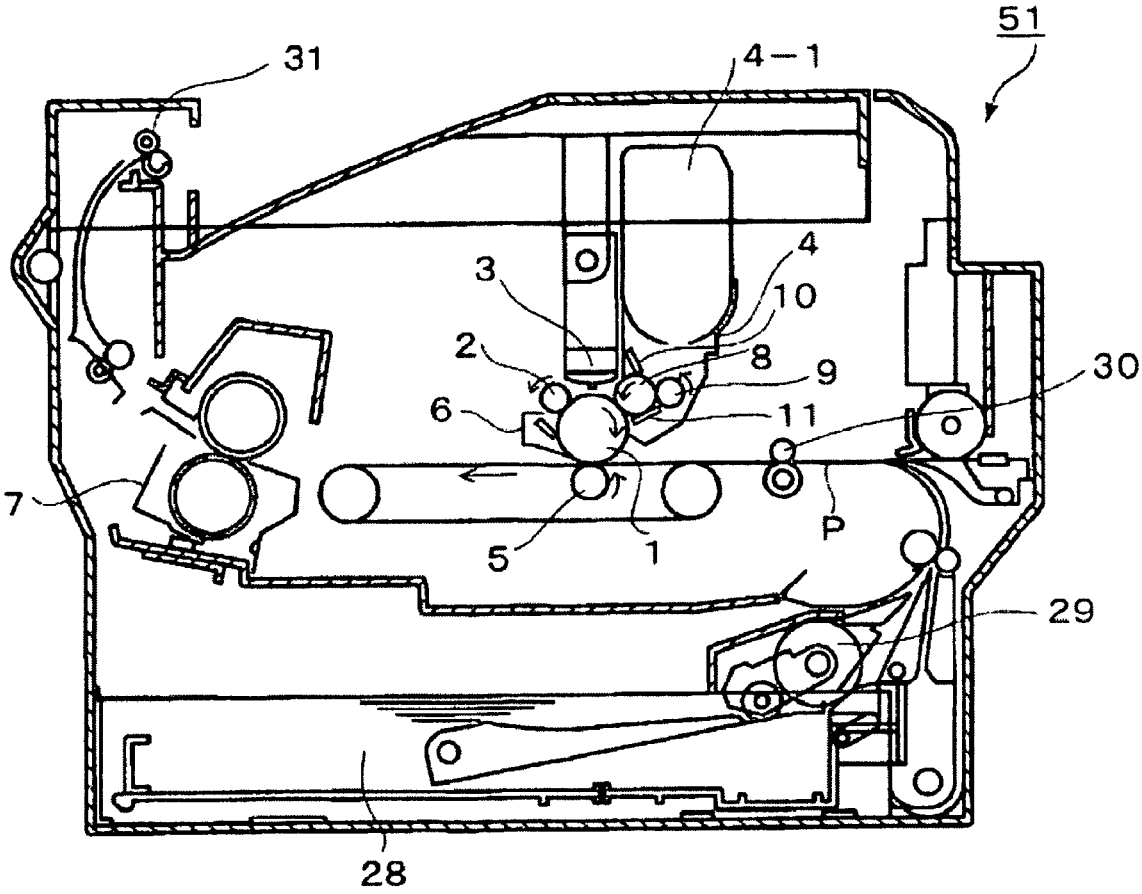
FIG. 1 is a schematic view showing an image forming apparatus according to a first embodiment of the present invention.

A first embodiment of the present invention will be explained. FIG. 1 is a schematic view showing an image forming apparatus 51 according to the first embodiment of the present invention.

As shown in FIG. 1, the image forming apparatus 51 includes a photosensitive drum 1 as an image supporting member; a charging roller 2 as a charging device disposed near the photosensitive drum 1; an LED (Light Emitting Diode) head 3 as an exposure device; a developing device 4; a transfer roller 5 as a transfer member; a cleaning device 6; a fixing device 7 disposed on a transport path of a recording medium P; a tray 28 for retaining the recording medium P; a hopping roller 29 for picking up the recording medium P from the tray 28; a resister roller 30 for transporting the recording medium P with a skew; and a discharge roller 31 for discharging the recording medium P outside the image forming apparatus 51.

In the embodiment, the photosensitive drum 1 includes a conductive member with a drum shape formed of aluminum and a photoconductive layer disposed on a surface of the conductive member. The charging roller 2 uniformly charges a surface of the photosensitive drum 1, and is formed of a conductive member formed of stainless steel and a conductive elastic layer disposed on the conductive member and formed of epichlorohydrin. The charging roller 3 is disposed to contact with the photosensitive drum 1.

In the embodiment, the LED head 3 selectively exposes the surface of the photosensitive drum 1 thus uniformly charged to form a static latent image thereon. The LED head 3 includes an LED element, an LED drive element, and a lens array. The LED head 3 is disposed at a position so that irradiated light focuses on the surface of the photosensitive drum 1.

In the embodiment, the developing device 4 develops a static latent image formed on the photosensitive drum 1 to form a toner image. The developing device 4 includes a developing roller 8 as a developer supporting member; a supply roller 9 as a developer supply member disposed to contact with the developing roller 8; and a regulation blade 10 as a regulation member or a developer layer forming member disposed to abut against the developing roller 8 at a distal end portion thereof. The developing roller 8 is formed of a conductive member formed of stainless steel and a conductive elastic member formed of urethane and covering the conductive member. The supply roller 9 is formed of a conductive member formed of stainless steel and a foam elastic member disposed on the conductive member and formed of silicone. The regulation blade 10 is formed of a plate member formed of stainless steel. A toner cartridge 4-1 is disposed above the developing device 4 for supplying toner (not shown) into the developing device 4. Further, the developing device 4 is disposed at a position such that the developing roller 8 contacts with the surface of the photosensitive drum 1.

In the embodiment, a toner charge regulation member 11 as a charge adjustment member or a developer layer charge adjustment member is disposed to contact with the developing roller 8 for preventing toner from scattering on the recording medium P and for adjusting a charge amount of toner on the developing roller 8 and in the developing device 4. The toner charge regulation member 11 is formed of a plate member formed of a conductive Teflon (trademark) member.

In the embodiment, the transfer roller 5 transfers the toner image formed on the photosensitive drum 1 to the recording medium P, and is formed of a conductive foam elastic member. The transfer roller 5 is disposed at a position to contact with the photosensitive drum 1.

In the embodiment, the cleaning device 6 scrapes off and discards toner remaining on the photosensitive drum 1 untransferred or toner waste moved from the developing device 4 to the photosensitive drum 1. The cleaning device 6 is formed of a rubber blade, and is disposed such that a distal end portion of the rubber blade abuts against the surface of the photosensitive drum 1. Further, the fixing device 7 fixes the toner image transferred to the recording medium P through heat and pressure.

In the embodiment, an ID motor 12 (refer to FIG. 2) as a drive unit drives the photosensitive drum 1 to rotate in an arrow direction. When the photosensitive drum 1 rotates, the developing roller 8 and the supply roller 9 rotate through a gear. Further, when the photosensitive drum 1 rotates, the charging roller 2 rotates through friction.

Figure 2:
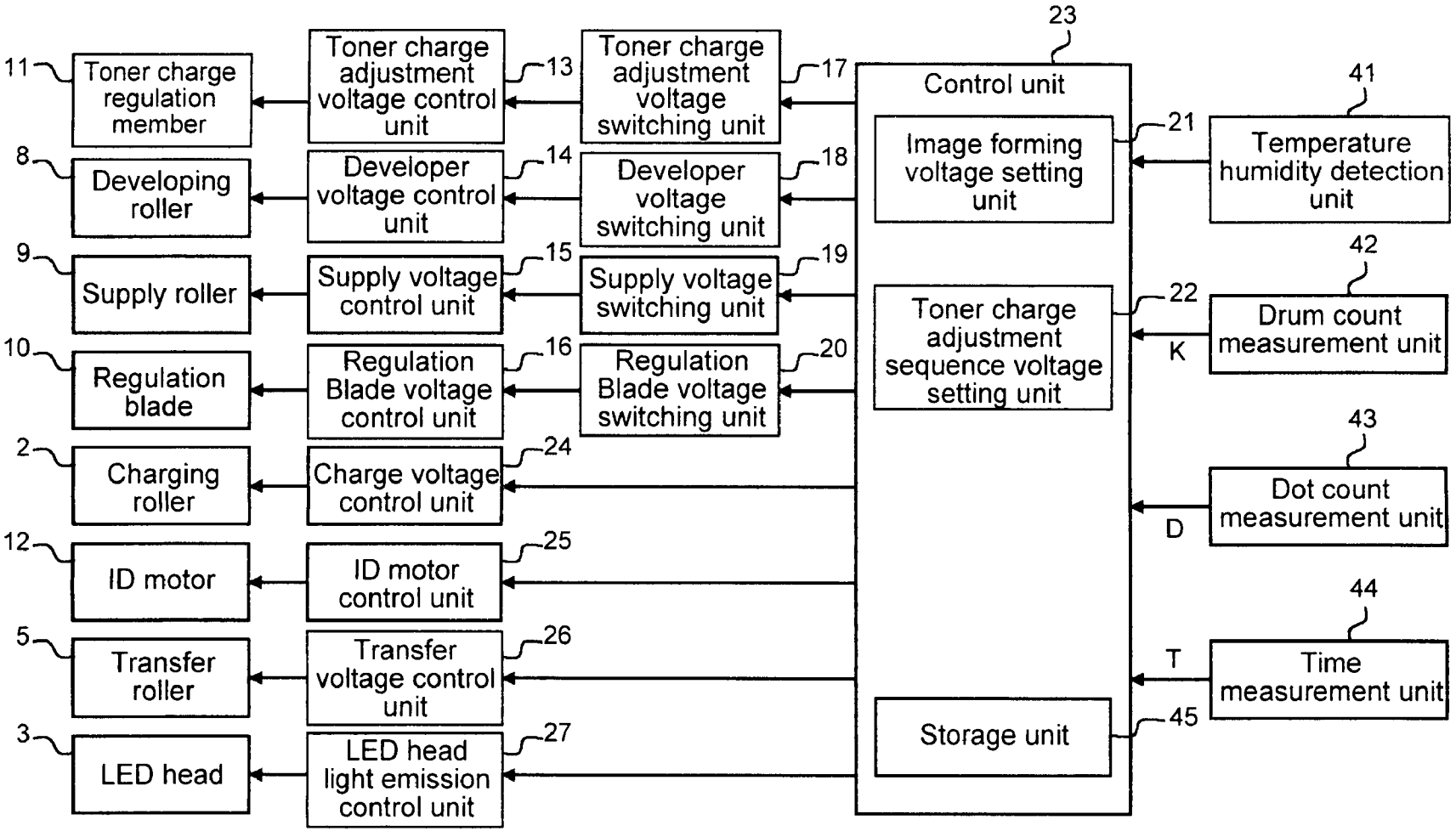
FIG. 2 is a block diagram showing the image forming apparatus according to the first embodiment of the present invention.

FIG. 2 is a block diagram showing the image forming apparatus 51 according to the first embodiment of the present invention.

As shown in FIG. 2, a toner charge adjustment voltage control unit 13 as a first voltage control unit (a charge adjustment voltage control unit or a charge adjustment member applied voltage control unit) applies a toner charge adjustment voltage to the toner charge regulation member 11; a developer voltage control unit 14 as a second voltage control unit applies a developing voltage to the developing roller 8; a supply voltage control unit 15 as a third voltage control unit applies a supply voltage to the supply roller 9; and a regulation blade voltage control unit 16 as a fourth voltage control unit (or a regulation member voltage control unit) applies a regulation blade voltage to the regulation blade 10.

In the embodiment, the toner charge adjustment voltage control unit 13 is connected to a toner charge adjustment voltage switching unit 17 as a first voltage switching unit (a charge adjustment voltage switching unit or a charge adjustment member applied voltage switching unit); the developer voltage control unit 14 is connected to a developing voltage switching unit 18 as a second voltage switching unit; the supply voltage control unit 15 is connected to a supply voltage switching unit 19 as a third voltage switching unit; and the regulation blade voltage control unit 16 is connected to a regulation blade voltage switching unit 20 as a fourth voltage switching unit (or an adjustment member voltage switching unit).

In the embodiment, according to a direction from a control unit 23, the toner charge adjustment voltage switching unit 17, the developing voltage switching unit 18, the supply voltage switching unit 19, and the regulation blade voltage switching unit 20 switch between an image forming voltage stored in an image forming voltage setting unit 21 and a toner charge adjustment sequence voltage stored in a toner charge adjustment sequence voltage setting unit 22 as a charge adjustment sequence voltage setting unit (or a toner charge adjustment sequence voltage setting unit). Then, the toner charge adjustment voltage switching unit 17, the developing voltage switching unit 18, the supply voltage switching unit 19, and the regulation blade voltage switching unit 20 send voltage setting values to the toner charge adjustment voltage control unit 13, the developer voltage control unit 14, the supply voltage control unit 15, and the regulation blade voltage control unit 16, respectively. According to the voltage setting values thus sent, the toner charge adjustment voltage control unit 13, the developer voltage control unit 14, the supply voltage control unit 15, and the regulation blade voltage control unit 16 output voltages, respectively.

As shown in FIG. 2, the charging roller 2 is connected to a charge voltage control unit 24 as a fifth voltage control unit; the ID motor 12 is connected to an ID motor control unit 25 as a drive control unit; the transfer roller 5 is connected to a transfer voltage control unit 26 as a sixth voltage control unit; and the LED head 3 is connected to an LED head light emission control unit 27 as an exposure control unit.

In the embodiment, according to a direction from the control unit 23, the charge voltage control unit 24, the ID motor control unit 25, the transfer voltage control unit 26, and the LED head light emission control unit 27 control a charge voltage to be applied to the charging roller 2, a drive operation of the ID motor 12, a transfer voltage to be applied to the transfer roller 5, and an emission operation of the LED head 3, respectively.

In the embodiment, the image forming apparatus 51 further includes a temperature humidity detection unit 41 for detecting a temperature (° C.) and a humidity (% RH); a drum count measurement unit 42 for measuring a drum count K; a dot count measurement unit 43 for measuring a dot count D; a time measurement unit 44 for measuring a time T; a storage unit 45 for storing a drum count K, a dot count D, and a time T.

According to the temperature, the humidity, the drum count D, and the dot count K, the control unit 23 calculates an absolute water amount (g/m$^3$) from an equation (A); an image ratio from an equation (B); and a print frequency from an equation (C) (described later). Further, the control unit 23 determines a voltage setting table (refer to FIGS. 3 and 4) using results of the calculations described above and the drum count K. The storage unit 45 stores the drum count K, the dot count D, and the time T output to the control unit 23.

In the embodiment, the absolute water amount represents an amount of water per unit volume in the air. The drum count represents an accumulated number of rotations of the photosensitive drum 1. For example, when three of A4 size sheets are transported continuously in a longitudinal direction thereof, an inclement in the drum count becomes three counts, even though a longitudinal length of the A4 size sheet is 210 mm and a circumferential length of the photosensitive drum 1 is 94 mm. The control unit 23 increases the drum count according to a number of rotations of the ID motor 12.

In the embodiment, the dot count represents an accumulated number of image dots, and the print frequency represents an inclement in the drum count for a specific period of time. The image ratio represents a ratio of image dots per one A4 size sheet relative to 100% when an entire area of the A4 size sheet is exposed. The image dots per one A4 size sheet are calculated from an inclement in image dots when the drum count increases by a specific amount.

An operation of the image forming apparatus 51 will be explained next. In a printing process of the image forming apparatus 51, after a charge voltage is applied to the charging roller 2 to uniformly charge the surface of the photosensitive drum 1, the LED head 3 emits light according to image data from the control unit 23, thereby forming a static latent image pattern on the surface of the photosensitive drum 1. A developing voltage is applied to the developing roller 8 with a toner thin layer formed thereon, thereby developing the static latent image pattern on the photosensitive drum 1.

At this time, according to the voltage setting values described above, the supply voltage control unit 15 applies a supply voltage to the supply roller 9; the regulation blade voltage control unit 16 applies a regulation blade voltage to the regulation blade 10; and the toner charge adjustment voltage control unit 13 applies a toner charge adjustment voltage to the toner charge regulation member 11. Accordingly, the toner thin layer is uniformly formed on the developing roller 8, and toner in the toner thin layer is charged at a specific level.

In the next step, the transfer voltage control unit 26 applies a transfer voltage to the transfer roller 5. After the toner image on the photosensitive drum 1 is transferred to the recording medium P, the fixing device 7 fixes the toner image to the recording medium P. After the toner image is fixed to the recording medium P, the discharge roller 31 discharges the recording medium P outside the image forming apparatus, thereby completing the printing process.

When the image forming apparatus 51 is operated under a normal temperature of 23° C. and a normal humidity of 50% RH using toner of a negatively charged type, for example, the charge voltage is set to −1,000 V, the developing voltage is set to −200 V, the supply voltage is set to −280 V, the regulation blade voltage is set to −280 V, and the toner charge adjustment voltage is set to −100 V.

When the charge voltage greater than a specific value is applied to the charging roller 2, the surface of the photosensitive drum 1 is charged, and a surface voltage changes proportionally to the charge voltage thus applied. In the case described above, the surface voltage becomes −500V. Further, the LED head 3 emits light to form the static latent image pattern having a static latent image voltage of −100V, so that toner is reversely developed to the static latent image pattern from the developing roller 8. In toner of the negatively charged type, silica and the likes is added to a polystyrene resin for imparting charging property and flow ability.

In the toner thin layer formed on the developing roller 8, only toner corresponding to the static latent image pattern contributes to developing. Accordingly, when an image ratio of the image data is low, a large amount of toner remains without being developed. As a result, toner without being developed returns to the developing device 4 while being attached to the developing roller 8, and may be supplied to the photosensitive drum 1 after being scraped off with the supply roller 9, or being charged through friction between the developing roller 8 and the supply roller 9, or being charged through friction between the developing roller 8 and the regulation blade 10, or through friction between the developing roller 8 and the toner charge regulation member 11. Further, toner without being developed may not pass through the regulation blade 10 and remain in the developing device 4.

When the printing operation is performed continuously with a low image ratio, toner without being developed on the developing roller 8 or in the developing device 4 may be damaged, and an outer additive such as silica may be separated or embedded, thereby lowering charge property or being charged negatively. Further, toner is not scraped off with the supply roller 9, and is charged repeatedly while being attached to the developing roller 8, thereby increasing a charge amount thereof.

More specifically, when toner is rubbed between the developing roller 8 and the supply roller 9, or the developing roller 8 and the regulation blade 10, the outer additive attached to a surface of toner is separated, or is embedded into toner, thereby damaging toner. As a result, the outer additive does not remain on the surface of toner, thereby lowering the charge amount of toner. When toner remains on the developing roller 8 without being developed, toner continues to be charged through a rotation of the developing roller 8, thereby being excessively charged and increasing the charge amount of toner.

In the first embodiment, the toner charge regulation member 11 is provided for applying a voltage with a polarity the same as or opposite to that of toner. Accordingly, when the charge amount of toner decreases or increases, or toner is charged with an opposite polarity, it is possible to adjust the charge amount to a normal value. Further, when the image forming apparatus 51 is preparing for the printing operation, a developing voltage, a supply voltage, a regulation blade voltage, and a toner charge adjustment voltage all different from those for forming an image are applied to the developing roller 8, the supply roller 9, the regulation blade 10, and the toner charge regulation member 11, respectively. Additionally, the developing device 4 and the photosensitive drum 1 rotate in idle, i.e., without forming an image, so that a toner charge amount adjustment sequence is preformed.

In the first embodiment, the toner charge amount adjustment sequence is preformed every time the regulation blade voltage switching unit 20 counts when the image data are received. When the image data correspond to a plurality of sheets and the drum count exceeds 20 counts upon forming an image, the toner charge amount adjustment sequence is preformed when the image data are received at the next time. Further, when the image forming apparatus 51 is preparing for the printing operation, the photosensitive drum 1 rotates in idle corresponding to the drum count of 5 counts.

A voltage setting table of the developing voltage, the supply voltage, the regulation blade voltage, and the toner charge adjustment voltage will be explained next. FIG. 3 is a voltage setting table upon forming an image according to the first embodiment of the present invention. FIG. 4 is a voltage setting table in the toner charge adjustment sequence according to the first embodiment of the present invention.

As shown in FIGS. 3 and 4, each of the voltage setting tables upon forming an image and in the toner charge adjustment sequence include an environment table (1), an elapsed time table (2), an image ratio table (3), and a print frequency table (4). A voltage is determined through a calculation among the tables.

In the embodiment, the environment table (1) is determined from the absolute water amount calculated from a temperature and a humidity. The elapsed time table (2) is determined from the drum count. The image ratio table (3) is determined from the image ratio. The print frequency table (4) is determined from the print frequency.

In the embodiment, the absolute water amount, the image ratio, and the print frequency are calculated from the following equations (A) to (C):

$$\text{absolute water amount}=(0.0225\times \text{temperature}\times \text{temperature}+0.1568\times \text{temperature}+5.205)/(\text{humidity}/100) \quad (A)$$

$$\text{image ratio}=\{(Da-Db)/(Ka\times 15840)\}\times 100 \quad (B)$$

$$\text{print frequency}=Ka-Kb \quad (C)$$

where Ka is a set drum count; Da is a current dot count; Db is a dot count before the drum count Ka; Ta is a set time; and Kb is a drum count before the time Ta. A total number of the dots printable per one drum count is 15840.

In the embodiment, the set drum count Ka, the current drum count Da, the dot count Db before the drum count Ka, the set time Ta, and the drum count Kb before the time Ta are stored in the storage unit 45. In the image ratio table (3), an inclement of the drum count is 100 counts. In the print frequency table (4), the image ratio is calculated at a time of 5 hours. When a value is smaller than the range, a value at a left end is used. When a value is greater than the range, a value at a right end is used.

An example of setting the toner charge adjustment voltage will be explained next. When the absolute water amount is 5 g/m3, the drum count is 3,000 counts, the image ratio is 10%, and the print frequency is 250 counts, as indicated with * in FIG. 3, the toner charge adjustment voltage upon forming an image is determined as follows:

$$(-10)+(-25)+(0)+(100)=65(V)$$

Further, as indicated with * in FIG. 4, the toner charge adjustment voltage in the toner charge adjustment sequence is determined as follows:

$$(50)+(-35)+(-10)+(120)=125(V)$$

In the embodiment, the interval of the toner charge adjustment sequence, the idle rotations of the photosensitive drum 1, the set values in the tables, the inclement of the drum count upon calculating the image ratio, and the time upon calculating the print frequency are just examples, and can be adjusted according to a charge characteristic of toner and a process condition such as a roller characteristic to stabilize the charge amount of toner.

Further, when a plurality of sheets is printed, it is possible to perform the toner charge adjustment sequence between the sheets, not limited to when the image data are received. In this case, a plurality of sheets is printed with an interval large enough for performing the toner charge adjustment sequence, or a plurality of sheets is divided for performing the toner charge adjustment sequence.

Figure 5:
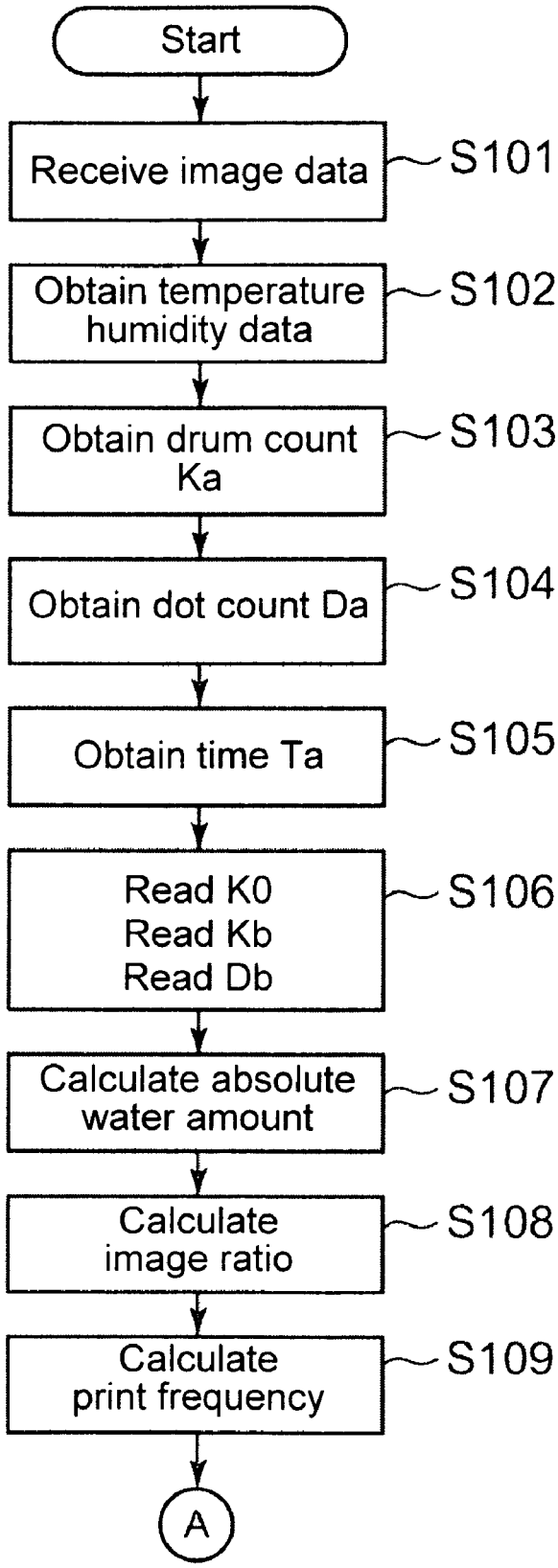
FIG. 5 is a flow chart No. 1 showing an operation of the image forming apparatus according to the first embodiment of the present invention.
Figure 6:
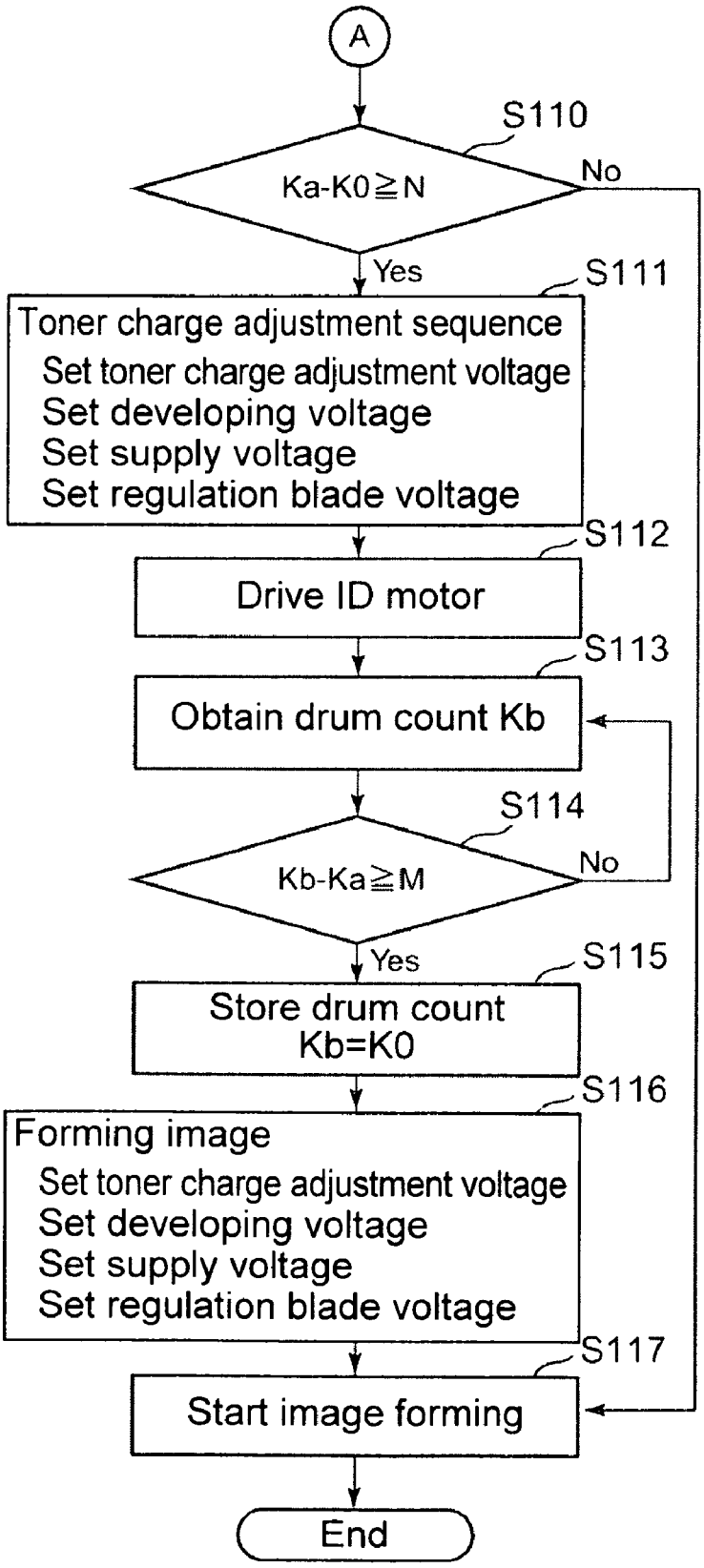
FIG. 6 a flow chart No. 2 showing the operation of the image forming apparatus according to the first embodiment of the present invention.

An operation of the image forming apparatus 51 will be explained next. FIG. 5 is a flow chart No. 1 showing the operation of the image forming apparatus 51 according to the first embodiment of the present invention. FIG. 6 a flow chart No. 2 showing the operation of the image forming apparatus 51 according to the first embodiment of the present invention.

In step S101, the control unit 23 receives the image data. In step S102, the control unit 23 obtains temperature humidity data detected with the temperature humidity detection unit 41. In step S103, the control unit 23 obtains the drum count Ka of the photosensitive drum 1 measured with the drum count measurement unit 42. In step S104, the control unit 23 obtains the dot count Da measured with the dot count measurement unit 43. In step S105, the control unit 23 obtains the time Ta measured with the time measurement unit 44.

In step S106, the control unit 23 reads the drum count K0 at the end of the toner charge adjustment sequence previously performed, the drum count Kb before the specific time, and the dot count Db before the specific drum count from the storage unit 45. In step S107, the control unit 23 calculates the absolute water amount from the equation (A) from the values obtained in steps S102, S103, S104, S105, and S106. In step S108, the control unit 23 calculates the image ratio from the equation (B). In step S109, the control unit 23 calculates the print frequency from the equation (C).

In step S110, the control unit 23 calculates Ka−K0 from the drum count Ka obtained in step S103 and the drum count K0 obtained in step S106. Then, the control unit 23 determines whether a result of the calculation is greater than a specific value N. The specific value N is a parameter for determining the interval of the toner charge adjustment sequence, and is set to 20 (N=20) in the embodiment. When the result of the calculation is greater than the specific value N (Ka−K0≧N), the process proceeds to step S111, thereby performing the toner charge adjustment sequence. When the result of the calculation is smaller than the specific value N (Ka−K0<N), the process proceeds to step S117, thereby not performing the toner charge adjustment sequence.

In step S111, the control unit 23 sends directions to the toner charge adjustment voltage control unit 13, the developer voltage control unit 14, the supply voltage control unit 15, and the regulation blade voltage control unit 16 to set the voltages in the toner charge adjustment sequence. Accordingly, the toner charge adjustment voltage control unit 13, the developer voltage control unit 14, the supply voltage control unit 15, and the regulation blade voltage control unit 16 set the toner charge adjustment voltage, the developing voltage, the supply voltage, and the regulation blade voltage, respectively, from the drum count Ka obtained in step S103, the results of the calculations obtained in steps S107, S108, and S109, and the voltage setting table in the toner charge adjustment sequence shown in FIG. 4.

In step S112, the ID motor control unit 25 drives the ID motor 12 to rotate the photosensitive drum 1 in idle. In step S113, the drum count measurement unit 42 obtains the drum count Kb of the photosensitive drum 1 in the toner charge adjustment sequence.

In step S114, the control unit 23 calculates Kb−Ka from the drum count Kb and the drum count Ka. Then, the control unit 23 determines whether a result of the calculation is greater than a specific value M. The specific value M is a parameter for determining the rotations of the photosensitive drum 1 in idle, and is set to 5 (M=5) in the embodiment. When the result of the calculation is greater than the specific value M (Kb−Ka≧M), the process proceeds to step S115. When the result of the calculation is smaller than the specific value M (Kb−Ka<M), the process returns to step S113, thereby continuously rotating the photosensitive drum 1 in idle. In step S115, the storage unit 45 makes the drum count Kb equal to the drum count K0 (Kb=K0), and stores the drum count when the toner charge adjustment sequence is completed.

In step S116, the toner charge adjustment voltage switching unit 17, the developing voltage switching unit 18, the supply voltage switching unit 19, and the regulation blade voltage switching unit 20, the control unit 23 sends directions to the toner charge adjustment voltage control unit 13, the developer voltage control unit 14, the supply voltage control unit 15, and the regulation blade voltage control unit 16 to switch the voltage setting values from those upon forming an image to those in the toner charge adjustment sequence.

Accordingly, the toner charge adjustment voltage control unit 13, the developer voltage control unit 14, the supply voltage control unit 15, and the regulation blade voltage control unit 16 set the toner charge adjustment voltage, the developing voltage, the supply voltage, and the regulation blade voltage, respectively, from the drum count Kb obtained in step S113, the results of the calculations obtained in steps S107, S108, and S109, and the voltage setting table upon forming an image shown in FIG. 3. In step S117, the image forming operation starts.

An experiment was conducted for evaluating fog and stain. FIG. 7 is a table showing a result No. 1 of the experiment according to the first embodiment of the present invention. FIG. 8 is a table showing a result No. 2 of the experiment according to the first embodiment of the present invention. FIG. 9 is a table showing a result No. 3 of the experiment according to the first embodiment of the present invention.

In general, the fog occurs when toner with a charge amount smaller than normally charged toner or with an opposite charge polarity is attached to a background portion of an image, i.e., a non-printed area. Toner with a charge amount smaller than normally charged toner or with an opposite charge polarity, i.e., toner causing the fog, is referred to as fog toner.

In general the stain occurs when toner with a charge amount greater than normally charged toner, i.e., excessively charged toner, is attached to a background portion of an image, i.e., a non-printed area. Toner with a charge amount greater than normally charged toner, i.e., toner causing the stain, is referred to as stain toner.

In the experiment, in order to evaluate the fog, an A4 size gloss sheet (a weight=1,280 g/m$^2$, a gloss of 58.7 measured with MURAKAMI COLOR RESEARCH LABORATORY GLOSS METER, Type GM-26D, at a view angle of 75°) was transported without forming an image thereon, i.e., white printing. Then, a color difference meter CM-2600d (a product of Konica Minolta Holdings Inc., C light source, 2 degree view angle) was used to measure a color difference (ΔE) in hue (L*a*b) of the A4 size gloss sheet with and without the white printing.

When the color difference (ΔE) increased, it was indicated that a large amount of toner was attached to the sheet with the white printing, i.e., the fog was large and quality was poor. In the experiment, when the color difference (ΔE) was less than 1.0, the result was good. When the color difference (ΔE) was between 1.0 and 1.5, the result was fair. When the color difference (ΔE) was greater than 1.5, the result was poor.

In the experiment, in order to evaluate the stain, a 40% pattern was formed on a sheet. When toner was attached to a white area of the sheet, dots constituting the pattern were smeared, thereby causing the stain. More specifically, toner was attached to a white area other than a dot forming area. Accordingly, a density difference was created between an area with an increased density and an area without an increased density. When the density variance was created, it was considered that the stain occurred.

In order to evaluate the stain, a density (OD1) of the area with an increased density was compared with a density (OD2) of the area without an increased density. Then, the density difference was calculated as follows:

$$\text{density difference}=((OD1-OD2)\times 100)/OD2$$

In the experiment, when the density difference was less than 15%, it was considered that the stain did not occur and the result was good. When the density difference was between 15% and 20%, it was considered that the stain did occur slightly and the result was fair. When the density difference was more than 20%, it was considered that the stain did occur noticeably and the result was poor. The density was measured with a density meter X-Rite 504 (a product of X-Rite Corp.). The recording medium P was OKI DATA excellent white paper.

As shown in FIG. 7, the table shows the result of environmental conditions, the fog, and the stain. The experiment was conducted when the drum count was zero count under each of the environmental conditions. Before the embodiment was adopted, the fog became worse with increasing the absolute water amount, and the stain became worse with decreasing the absolute water amount. After the embodiment was adopted, the fog and the stain were improved.

As shown in FIG. 8, the table shows the result of the fog and the stain with various drum counts. The experiment was conducted when the printing operation was continuously performed at the image ratio of 1% under a temperature of 23° C. and a humidity of 50% RH. Before the embodiment was adopted, the fog became worse with increasing the drum count. After the embodiment was adopted, the fog was improved, in which the fog occurred slightly at the drum count of 20,000. The stain did not occur before and after the embodiment was adopted.

As shown in FIG. 9, the table shows the result of the fog and the stain with various drum counts. The experiment was conducted when the printing operation was continuously performed at the image ratio of 1% from the drum count of 3,000 to 4,000. Before the embodiment was adopted, the fog became worse when the drum count was small at a specific time. Further, the fog was improved when the drum count increased, but the stain occurred. After the embodiment was adopted, the fog and the stain did not occur regardless of the drum count at a specific time.

As explained above, in the embodiment, the toner charge regulation member 11 is provided for performing the toner charge adjustment sequence. Accordingly, it is possible to stabilize the charge amount of toner, thereby reducing the fog and the stain.

More specifically, in the embodiment, the toner charge regulation member 11 is provided for applying a voltage. Further, when the image forming apparatus 51 is preparing for the printing operation, the toner charge adjustment sequence is performed in which the developing device 4 operates in idle at the voltage setting different from that for forming an image. Accordingly, it is possible to adjust the charge amount of toner in the developing device 4, even when toner is excessively charged, has a low charge amount, or is charged with an opposite polarity, thereby forming a good image with less fog and stain.

Second Embodiment

A second embodiment of the present invention will be explained next. In the first embodiment, the toner charge adjustment sequence is performed when the image data are received. In the second embodiment, the image data include a density correction image.

Figure 10:
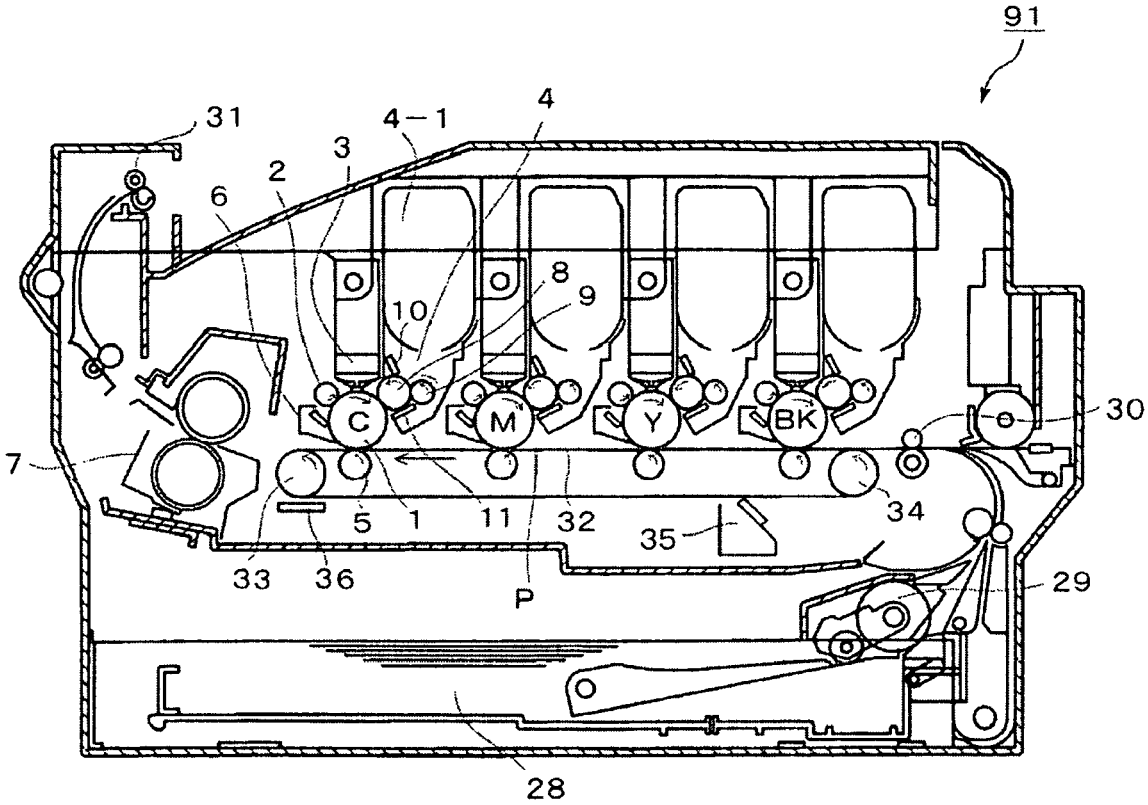
FIG. 10 is a schematic view showing an image forming apparatus according to a second embodiment of the present invention.

FIG. 10 is a schematic view showing an image forming apparatus 91 according to the second embodiment of the present invention. While the image forming apparatus 51 in the first embodiment is a monochrome image forming apparatus, the image forming apparatus 91 in the second embodiment is an image forming apparatus of a color tandem type.

Similar to the first embodiment, the image forming apparatus 91 includes the photosensitive drum 1, the charging roller 2, the LED head 3, the developing device 4, the transfer roller 5, and the cleaning device 6 arranged according to colors of toner in an order of black (BK), yellow (Y), magenta (M), and cyan (C) from an upstream side in a sub-scanning direction. Further, the image forming apparatus 91 includes the fixing device 7, the tray 28, the hopping roller 29, the resister roller 30, and the discharge roller 31 similar to those in the first embodiment.

In the embodiment, the image forming apparatus 91 further includes a transfer belt 32 for transporting the recording medium P and transferring developer; a drive roller 33 for driving the transfer belt 32; an idle roller 34 for stabilizing the drive of the transfer belt 32; a belt cleaning member 35 for cleaning toner on the transfer belt 32; and a density sensor 36 for detecting a density of the density correction image (described later) formed on the transfer belt 32.

An operation of the image forming apparatus 91 will be explained next. A printing operation of the image forming apparatus 91 is similar to that in the first embodiment, and an explanation thereof is omitted. In the first embodiment, the toner charge adjustment sequence is performed when the image data are received. In the second embodiment, the image data include the density correction image. Accordingly, the toner charge adjustment sequence may be performed just before a density correction operation.

A method of the density correction will be explained. In the density correction, several images with specific image ratios are formed on the transfer belt 32, and the density sensor 36 disposed at a center in a main scanning direction detects densities of the images. Then, the control unit 23 retrieves a calculation method stored in the storage unit 45 for adjusting the developing voltage applied to the developing roller 8 and an LED emission amount of the LED head 3.

In the embodiment, the density correction may be performed when the image forming apparatus 91 is turned on; an image forming unit is replaced; a toner cartridge is replaced; a specific drum count is achieved; or the image data are received after no image forming operation is performed for a specific period of time.

Figure 11:
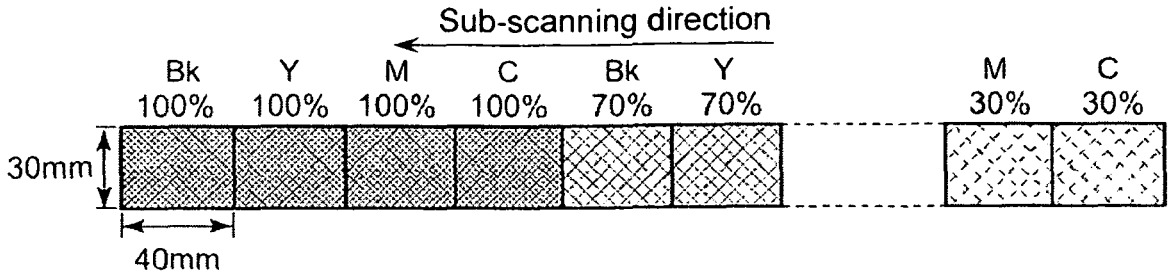
FIG. 11 is a schematic view showing a density correction image according to the second embodiment of the present invention.

FIG. 11 is a schematic view showing the density correction image according to the second embodiment of the present invention. The density correction image includes a plurality of sections having a size of 30 mm in the main scanning direction and a size of 40 mm in the sub-scanning direction. The sections are printed in colors with area ratios of 100%, 70%, and 30%. Accordingly, the sections are arranged in the sub-scanning direction as BK 100%, Y 100%, M 100%, C 100%, BK 70%, to C 30%. When the density correction image is formed, the drum count increases by two counts. When the density correction image is changed, the drum count varies accordingly.

In the embodiment, the developing device 4 has an identical configuration for each color. Each of the developing devices 4 includes the voltage setting tables upon forming an image and in the toner charge adjustment sequence formed of the environment table (1), the elapsed time table (2), the image ratio table (3), and the print frequency table (4) for each color. The drum count and the dot count are measured to set the voltage setting tables for each color, and the temperature, the humidity, and the time are common. The set values in the tables can be adjusted according to the charge amount of toner.

As described above, in the embodiment, in addition to before an image is formed on a sheet, the toner charge adjustment sequence can be performed before the density correction image is formed, thereby obtaining a good image with less fog and stain. Further, it is possible to minimize a difference in the charge amount of toner between when an image is formed on a sheet and when the density correction image is formed. Accordingly, it is possible to improve a density difference of an image on a sheet due to the environment, the elapsed time, the image ratio, and the print frequency.

Third Embodiment

Figure 12:
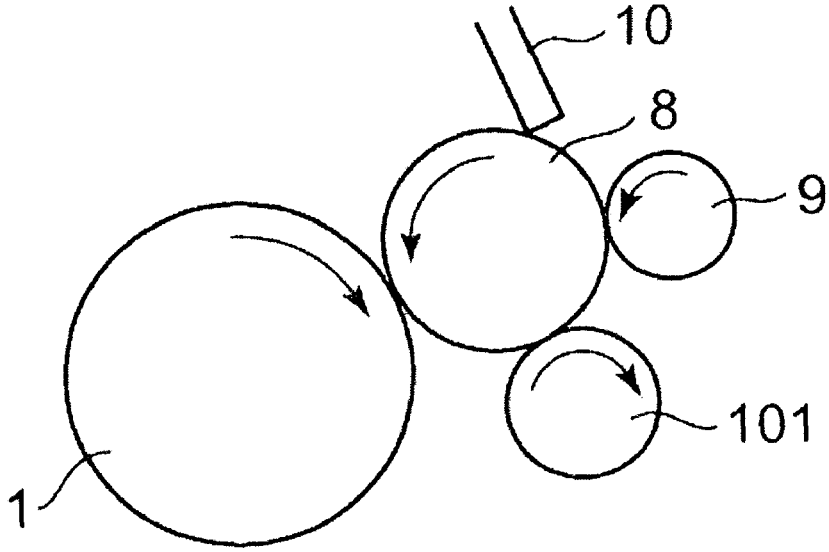
FIG. 12 is a schematic view showing a toner charge adjustment roller according to a third embodiment of the present invention.

A third embodiment of the present invention will be explained next. In the first embodiment, the toner charge regulation member 11 is formed of the plate shape member. In the third embodiment, a toner charge adjustment member is formed of a roller member. FIG. 12 is a schematic view showing a toner charge adjustment roller 101 according to the third embodiment of the present invention.

As shown in FIG. 12, the photosensitive drum 1 contacts with the developing roller 8, and the developing roller 8 contacts with the supply roller 9 for supplying toner. Further, the regulation blade 10 contacts with the developing roller 8 for forming a thin layer of toner. Further, the developing roller 8 contacts with the photosensitive drum 1 for developing a static latent pattern formed on the photosensitive drum 1. The toner charge adjustment roller 101 is disposed to contact with the developing roller 8, i.e., toner on the developing roller 8, for adjusting the charge amount of toner.

Figure 13:
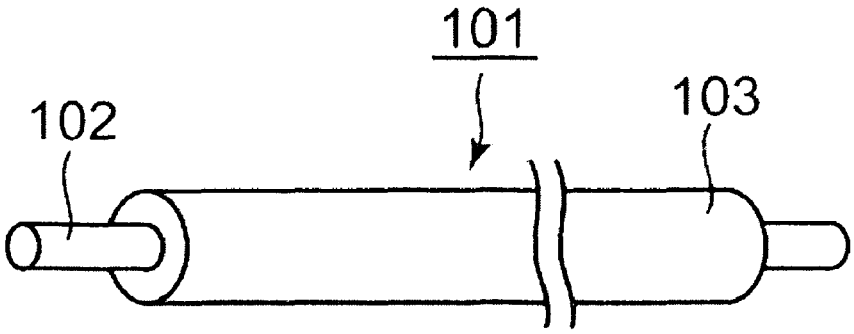
FIG. 13 is a schematic perspective view showing the toner charge adjustment roller according to the third embodiment of the present invention.

FIG. 13 is a schematic perspective view showing the toner charge adjustment roller 101 according to the third embodiment of the present invention. The toner charge adjustment roller 101 is formed of a conductive shaft 102 and a conductive elastic layer 103. The conductive shaft 102 is formed of a metal such as stainless steel, and the conductive elastic layer 103 is formed of a silicon rubber or a urethane rubber containing a conductive material such as carbon black.

In the embodiment, the conductive elastic layer 103 may be formed of a foamed rubber. Further, the conductive elastic layer 103 may be formed of one layer of a conductive rubber layer, two layers of a conductive rubber layer and a surface layer formed on the conductive rubber layer, or a plurality of layers including a conductive rubber layer and a surface layer.

As described above, in the third embodiment, similar to the first embodiment, the toner charge adjustment roller 101 is provided for applying a voltage. Further, before an image is formed while preparing for the printing operation, the toner charge adjustment sequence is performed in which the developing device 4 operates in idle at the voltage setting different from that for forming an image. Accordingly, it is possible to adjust the charge amount of toner in the developing device 4, even when toner is excessively charged, has a low charge amount, or is charged with an opposite polarity, thereby forming a good image with less fog and stain.

In the embodiments described above, the printer is explained as the image forming apparatus, and the present invention is applicable to a copier, a facsimile, and a multifunction product.

The disclosure of Japanese Patent Application No. 2008-024750, filed on Feb. 5, 2008, is incorporated in the application.

While the invention has been explained with reference to the specific embodiments of the invention, the explanation is illustrative and the invention is limited only by the appended claims.

What is claimed is:

1. An image forming apparatus comprising:

an image supporting member;

a developer supporting member for attaching developer to the image supporting member to form a developer image;

a regulation member for forming a thin layer of the developer on the developer supporting member;

a charge adjustment member for receiving a charge adjustment voltage and contacting with the thin layer of the developer to adjust a charge amount of the developer; and a charge adjustment voltage switching unit for switching the charge adjustment voltage between an image forming voltage upon forming an image and a non-image forming voltage different from the image forming voltage during a preparation operation, said image forming voltage having an absolute value smaller than that of the non-image forming voltage.

2. The image forming apparatus according to claim 1, further comprising a charge adjustment voltage control unit for applying the charge adjustment voltage to the charge adjustment member, said charge adjustment voltage control unit applying one of the image forming voltage and the non-image forming voltage to the charge adjustment member according to a signal of the charge adjustment voltage switching unit.

3. The image forming apparatus according to claim 1, further comprising a developing voltage control unit for applying a developing voltage to the developer supporting member, and a developing voltage switching unit for switching the developing voltage between a first voltage upon forming the image and a second voltage during the preparation operation.

4. The image forming apparatus according to claim 1, further comprising a regulation member voltage control unit for applying a regulation voltage to the regulation member, and a regulation member voltage switching unit for switching the regulation voltage between a first voltage upon forming the image and a second voltage during the preparation operation.

5. The image forming apparatus according to claim 1, further comprising a supply member for supplying the developer to the developer supporting member, a supply voltage control unit for applying a supply voltage to the supply member, and a supply voltage switching unit for switching the supply voltage between a first voltage upon forming the image and a second voltage during the preparation operation.

6. The image forming apparatus according to claim 1, further comprising a temperature humidity detection unit for detecting a temperature and a humidity, and a control unit for setting the image forming voltage and the non-image forming voltage according to the temperature and the humidity.

7. The image forming apparatus according to claim 1, further comprising a control unit for setting the image forming voltage and the non-image forming voltage according to a number of rotations of the image supporting member.

8. The image forming apparatus according to claim 1, further comprising a control unit for setting the image forming voltage and the non-image forming voltage according to an image ratio at a specific time.

9. The image forming apparatus according to claim 1, further comprising a control unit for setting the image forming voltage and the non-image forming voltage according to a print frequency at a specific time.

10. The image forming apparatus according to claim 1, wherein said charge adjustment voltage switching unit is adopted to switch the charge adjustment voltage between the image forming voltage and the non-image forming voltage during the preparation operation when a specific number of sheets are printed.

11. The image forming apparatus according to claim 1, wherein said charge adjustment voltage switching unit is adopted to switch the charge adjustment voltage between the image forming voltage and the non-image forming voltage during the preparation operation when image data are received.

12. A developing device comprising:

a developer supporting member for attaching developer to an image supporting member to form a developer image;

a regulation member for forming a thin layer of the developer on the developer supporting member; and a charge adjustment member for contacting with the thin layer of the developer to adjust a charge amount of the developer, said charge adjustment member receiving a charge adjustment voltage from a charge adjustment voltage control unit, said charge adjustment voltage including an image forming voltage upon forming an image and a non-image forming voltage different from the image forming voltage during a preparation operation, said image forming voltage having an absolute value smaller than that of the non-image forming voltage.

13. A method of adjusting developer, comprising the steps of:

selecting one of an image forming voltage upon forming an image and a non-image forming voltage different from the image forming voltage during a preparation operation as a charge adjustment voltage, said image forming voltage having an absolute value smaller than that of the non-image forming voltage; and applying the charge adjustment voltage to a charge adjustment member contacting with a thin layer of developer on a developer supporting member.

14. The method of adjusting developer according to claim 13, further comprising the step of rotating the developer supporting member in idle.

15. The method of adjusting developer according to claim 13, wherein, in the step of selecting one of the image forming voltage and the non-image forming voltage, a specific number of sheets are printed during the preparation operation.

16. The method of adjusting developer according to claim 13, wherein, in the step of selecting one of the image forming voltage and the non-image forming voltage, image data are received during the preparation operation.

17. The method of adjusting developer according to claim 16, wherein, in the step of selecting one of the image forming voltage and the non-image forming voltage, said image data include a density correction image.

18. The method of adjusting developer according to claim 17, further comprising the step of correcting a density after the step of applying the charge adjustment voltage.

* * * * *